US006251305B1

(12) United States Patent
Sartori et al.

(10) Patent No.: US 6,251,305 B1
(45) **Date of Patent: *Jun. 26, 2001**

(54) ESTERIFICATION OF ACIDIC CRUDES

(75) Inventors: Guido Sartori, Annandale; David W. Savage, Lebanon; David C. Dalrymple; Bruce H. Ballinger, both of Bloomsbury; Saul C. Blum, Edison; William E. Wales, Phillipsburg, all of NJ (US)

(73) Assignee: Exxon Research and Engineering Company, Annandale, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/167,155

(22) Filed: Oct. 6, 1998

(51) Int. Cl.[7] ..... C09K 3/32

(52) U.S. Cl. ..... 252/387; 252/388; 208/47; 208/48 R; 208/48 AA; 208/263

(58) Field of Search ..... 252/387, 388; 208/47, 48 R, 48 AA, 263

(56) References Cited

U.S. PATENT DOCUMENTS

| | | | | |
|---|---|---|---|---|
| 2,160,632 | * | 5/1939 | Yabroff et al. | 208/232 |
| 2,302,281 | * | 11/1942 | Watkins | 508/447 |
| 2,424,158 | * | 7/1947 | Fuqua et al. | 208/263 |
| 2,600,537 | * | 6/1952 | Honeycutt | 562/511 |
| 2,769,767 | * | 11/1956 | Fierce et al. | 208/263 |
| 2,769,768 | * | 11/1956 | Fierce et al. | 208/263 |
| 2,808,431 | * | 10/1957 | Fierce et al. | 562/511 |
| 2,850,435 | * | 9/1958 | Fierce et al. | 208/263 |
| 2,911,360 | * | 11/1959 | Myers | 208/263 |
| 3,846,288 | * | 11/1974 | Chun et al. | 208/263 |
| 4,199,440 | * | 4/1980 | Verachtert | 208/230 |
| 4,300,995 | * | 11/1981 | Liotta | 208/403 |
| 4,634,519 | * | 1/1987 | Danzik | 208/263 |
| 5,169,598 | | 12/1992 | Zetlmeisl et al. | 422/16 |
| 5,643,439 | * | 7/1997 | Sartori et al. | 208/47 |
| 5,683,626 | * | 11/1997 | Sartori et al. | 252/389.62 |

FOREIGN PATENT DOCUMENTS

| | | | |
|---|---|---|---|
| 4131406 | 11/1993 | (DE) | C10G/19/00 |
| 2024574C1 | 12/1994 | (RU) . | |

OTHER PUBLICATIONS

*Organic Chemistry*. 3rd Edition. Fieser and Fieser, 1956.*

E.Q. Camp, et. al., "Neutralization as a Means of Controlling Corrosion of Refinery Equipment", presented at the Fifth Annual Conference, National Association of Corrosion Engineers, Apr. 11–14, Cincinnati, Ohio, (Feb. 1950) vol. 6, pp. 39–44.

* cited by examiner

*Primary Examiner*—Gabrielle Brouillette
*Assistant Examiner*—LaToya Cross
(74) *Attorney, Agent, or Firm*—Estelle C. Bakun

(57) ABSTRACT

The present invention relates to a process for reducing the acidity of a petroleum oil containing organic acids comprising treating said petroleum oil containing organic acids with an effective amount of an alcohol at a temperature and under conditions sufficient to form the corresponding ester of said alcohol.

9 Claims, No Drawings

ESTERIFICATION OF ACIDIC CRUDES

FIELD OF THE INVENTION

The present invention relates to a process for reducing the acidity and corrosivity of petroleum oils.

BACKGROUND OF THE INVENTION

Whole crudes and crude fractions with high organic acid content such as those containing carboxylic acids, specifically naphthenic acids are corrosive to the equipment used to extract, transport and process the crudes.

Efforts to minimize organic acid corrosion have included a number of approaches by neutralizing and removing the acids from the oil. For example, U.S. Pat. No. 2,302,281 and Kalichevsky and Kobe in Petroleum Refining with Chemicals (1956), Chapter 4, disclose various base treatments of oils and crude fractions, e.g., using bases such as ammonia (page 170). U.S. Pat. No. 4,199,440 discloses treatment of a liquid hydrocarbon with a dilute aqueous alkaline solution, specifically dilute aqueous NaOH or KOH. U.S. Pat. No. 5,683,626 teaches treatments of acidic crudes with tetraalkylammonium hydroxide and U.S. Pat. No. 5,643,439 uses trialkylsilanolates. PCT US96/13688, US/13689 and US/13690 (Publication WO 97/08270, 97/08271 and 97/08275 dated Mar. 6, 1997) teach the use of Group IA and Group IIA oxides and hydroxides to treat whole crudes and crude fractions to decrease naphthenic acid content. U.S. Pat. No. 4,300,995 discloses the treatment of carbonaceous material particularly coal and its products, heavy oils, vacuum gas oil, petroleum resids having acidic functionalities with a dilute quaternary base, such as tetramethylammonium hydroxide in a liquid (alcohol or water). This patent was aimed at improving yields and physical characteristics of the products and did not address the question of acidity reduction.

While these processes have achieved varying degrees of success there is a continuing need to develop more efficient methods for treating acidic crudes.

SUMMARY OF THE INVENTION

The present invention relates to a process for reducing the acidity of a petroleum oil containing organic acids comprising treating said petroleum oil containing organic acids with an effective amount of an alcohol at a temperature and under conditions sufficient to form the corresponding ester of said alcohol.

The present invention may suitably comprise, consist or consist essentially of the elements disclosed and may be practiced in the absence of an element not disclosed.

DETAILED DESCRIPTION OF THE INVENTION

Some petroleum oils contain organic acids that contribute to corrosion or fouling of refinery equipment and that are difficult to separate from the processed oil. The organic acids generally fall within the category of naphthenic and other organic acids. Naphthenic acid is a generic term used to identify a mixture of organic acids present in petroleum stocks. Naphthenic acids may be present either alone or in combination with other organic acids, such as phenols. Naphthenic acids alone or in combination with other organic acids can cause corrosion at temperatures ranging from about 65° C. (150° F.) to 420° C. (790° F.). Reduction of the naphthenic acid content of such petroleum oils is a goal of the refiner.

The petroleum oils that may be treated in accordance with the instant invention are any organic acid-containing petroleum oils including whole crude oils and crude oil fractions that are liquid, liquifiable or vaporizable at the temperatures at which the present invention is carried out. As used herein the term whole crudes means unrefined, non-distilled crudes. The petroleum oils are preferably whole crudes.

Unexpectedly, Applicants have discovered that petroleum oils containing organic, specifically naphthenic acids, may have their naphthenic acid content reduced simply by treatment with an effective amount of alcohol. The treatment is conducted under conditions capable of converting the alcohol and acid to the corresponding ester. For example, if methanol is used, the methanol will be converted to methyl ester. Hence treatment temperatures will preferably range from about 250° C. and higher, preferably about 350° C. and higher and most preferably, about 250° C. to about 350° C. The temperature utilized should not exceed the cracking temperature of the petroleum oil. Pressures of from about 100 to 300 kPa are typical and generally result from the system itself. The molar ratio of petroleum acids to alcohol, typically ranges from about 1:0.5 to about 1:20, more preferably from about 1:1 to 1:10.

Optionally, any excess of methanol may be recovered and reused in either a batch or continuous process to contact additional untreated petroleum oil. Such recovery is readily accomplished by the skilled artisan.

Beneficially, the treatment with alcohol produces a treated crude that will not produce ash when burned unlike petroleum oils treated with inorganic oxides and hydroxides. Indeed, the esters produced from reaction of the acids and alcohols may be left in the petroleum oil without any detrimental effect.

The alcohols usable herein are commercially available. The alcohols may be selected from alkanols and alkane diols. The alkanols are preferably those having $C_1$ to $C_6$ carbons and the alkane diols are preferably those having $C_2$ to $C_6$ carbons. Preferably, the alcohol will be methanol or ethanol, most preferably methanol. The alcohols usable need only be capable of forming a thermally and hydrolytically stable ester with the acids contained in the petroleum oil being treated. Choice of alcohols meeting the above criteria is easily accomplished by the skilled artisan.

Treatment of the petroleum oils includes contacting the petroleum oil with an alcohol as described herein. Contacting times depend on the nature of the petroleum oil being treated and its acid content. Typically, contacting will be carried out from minutes to several hours. As noted previously, the contact time is that necessary to form an ester of the alcohol and acid. Applicants have also discovered that a slowly esterified crude may have its esterification rate increased by topping the crude and separating the lower boiling fraction, e.g., by separating the crude into its 650° F.$^+$ fraction and lower boiling fraction. The 650° F.$^+$ boiling fraction can then be esterified more rapidly, as compared to the whole crude, by treatment in accordance with the instant invention.

The concentration of acid in the crude oil is typically expressed as an acid neutralization number or acid number, which is the number of milligrams of KOH required to neutralize the acidity of one gram of oil. It may be determined according to ASTM D-664. Any acidic petroleum oil may be treated according to the present invention, for example, oils having an acid neutralization number of from 0.5 to 10 mg KOH/g acid. Typically, the decrease in acid content may be determined by a decrease in the neutralization number or in the intensity of the carboxyl band in the infrared spectrum at about 1708 $cm^{-1}$. Petroleum oils with acid numbers of about 1.0 and lower are considered to be of moderate to low corrosivity. Petroleum oils with acid numbers greater than 1.5 are considered corrosive. Acidic petroleum oils having free carboxyl groups may be effectively treated using the process of the present invention.

Petroleum oils are very complex mixtures containing a wide range of contaminants and in which a large number of competing reactions may occur. Thus, the reactivity of particular compounds to produce the desired neutralization is not predictable. Unexpectedly, in the current process the acidity of the oil is effectively reduced by the simple addition of alcohol. The simplicity of the process makes it highly desirable. Indeed, not only is the acidity of the petroleum oil reduced, but the oil is concurrently rendered less corrosive.

Indeed, an additional benefit of the present invention is that no acidic catalyst nor water removal is necessary to carry out the invention.

The present invention may be used in applications in which a reduction in the acidity of an acidic petroleum oil would be beneficial.

The present invention may be demonstrated with reference to the following non-limiting examples.

General Conditions

Titration of the carboxyl groups with KOH was carried out according to ASTM D-664. The reactions were carried out in a 300 ml autoclave, unless otherwise noted.

EXAMPLE 1

The reaction apparatus was a 300 ml autoclave. 100 g of Gryphon crude, having a total acid number of 4.2 mg KOH/g of oil, determined according to ASTM D-664, were put into the autoclave. 2.4 g of methanol were added, then the autoclave was closed and swept with nitrogen to displace air. After that, the autoclave was heated at 250° C. with stirring for 8 hours. After cooling, titration of the oil showed an 88% reduction in acidity. Examination by infrared spectroscopy showed that the band at 1708 $cm^{-1}$, attributed to carboxyl groups, had nearly disappeared. A new band had appeared at 1742 $cm^{-1}$, showing formation of ester groups. Based on infrared, 97% of the original carboxyl groups had been converted.

EXAMPLE 2

Example 1 was repeated, with the only difference that the reaction mixture was not blanketed with nitrogen. After heating the autoclave at 250° C. for 7.5 hours, it was cooled to room temperature and opened. Titration with KOH showed a total acid number of 0.8 mg KOH/g of oil, corresponding to an 81% conversion of the acids. Infrared examination showed a peak at 1742 $cm^{-1}$, indicating formation of esters. The peak at 1708 $cm^{-1}$, attributed to carboxyl groups, was very small and corresponded to a 95% conversion of the carboxyls.

EXAMPLE 3

This example shows the thermal stability of methylesters of naphthenic acids. The product of Example 2 was put back into the 300 ml autoclave described in Example 1 and heated at 350° C. for 3 hours. After cooling, titration with KOH showed a total acid number of 0.6 mg KOH/g of oil, indicating that the thermal treatment had not regenerated napacids. The infrared spectrum was practically identical to that of the product before heating, confirming the stability of the naphthenic acid methylesters.

EXAMPLE 4

The reaction apparatus was the same as in Example 1. 100 g of Gryphon crude were put into the autoclave. The exit valve of the autoclave was opened to allow low boilers to escape. Methanol was pumped into the autoclave at a rate of 1.2 ml per hour and the autoclave was stirred and brought to 250° C. in the course of 20 minutes. After the temperature of 250° C. was reached, the autoclave was stirred for 7 hours, while still maintaining a methanol flow of 1.2 ml per hour. Then the methanol addition was stopped and the autoclave was cooled while stirring.

Titration with KOH showed a total acid number of 2.7 mg KOH/g of oil, corresponding to a 36% conversion of acids. Infrared examination showed a band at 1742 $cm^{-1}$, indicating formation of esters. Based on the intensity of the band at 1708 $cm^{-1}$, attributed to carboxyl groups, 49% of them had been converted.

EXAMPLE 5

The reaction apparatus was the 300 ml autoclave described in Example 1. 100 g of Bolobo 2/4 crude, having a total acid number of 8.2 mg KOH/g of oil, were put in the autoclave, followed by 4.7 g of methanol. The autoclave was closed and heated at 250° C. while stirring for 7.5 hours. After cooling, titration gave a total acid number of 1.4 mg KOH/g of oil, corresponding to an 82% conversion.

EXAMPLE 6

The reaction apparatus was the 300 ml autoclave described in Example 1. 100 g of Gryphon crude and 2.4 g of methanol were put into the autoclave, which was then heated at 280° C. with stirring for 8 hours. After cooling, KOH titration showed a total acid number of 0.7 mg KOH/g of oil, corresponding to an 83% conversion of the acids.

EXAMPLE 7

This example demonstrates the thermal stability of naphthenic acid methylesters.

The product of Example 6 was put back into the 300 ml autoclave described in Example 1 and heated with stirring at 350° C. for 3 hours. After cooling, KOH titration showed a total acid number of 0.9 mg KOH/g of crude, i.e., very close to that of the unheated product.

EXAMPLE 8

The reaction apparatus was the 300 ml autoclave described in Example 1. 100 g of Gryphon crude and 3.45 g of ethanol were put into the autoclave, which was then closed and heated with stirring at 250° C. for 7.5 hours. After cooling, titration with KOH showed a total acid number of 1.7 mg KOH/g of oil, corresponding to a 60% conversion of naphthenic acids.

EXAMPLE 9

The reaction apparatus was a stirred glass vessel, equipped with Dean-Stark trap and reflux condenser. 50 g of Bolobo 2/4 crude and 0.93 g of ethylene glycol were put into the reactor, which was then heated until water and low boilers began to condense in the Dean-Stark trap. The temperature was about 170° C. When no more water condensed in the Dean-Stark trap, titration with KOH showed that the total acid number had dropped to 2.04 mg KOH/g of crude corresponding to a 75% conversion of naphthenic acids. Examination by infrared showed that the band at 1708 $cm^{-1}$, attributed to carboxylic groups, was much less intense than in untreated Bolobo 2/4. A new band had appeared at 1742 $cm^{-1}$ attributed to carboxyl esters.

EXAMPLE 10

The reaction apparatus was the same as in Example 9. 100 g of Bolobo 2/4 crude and 1.86 g of ethylene glycol were put into the vessel and heated at around 170° C. Water and low boilers condensed in the Dean-Stark trap. Infrared examination showed a gradual decrease of the intensity of the band at 1708 $cm^{-1}$, attributed to carboxyl groups, and formation of a band at 1742 $cm^{-1}$, attributed to ester groups. After a total of 263 hours the total acid number had dropped to 1.64 mg KOH/g corresponding to an 80% conversion of naphthenic acids.

EXAMPLE 11

The reaction apparatus was the 300 ml autoclave described in Example 1. 150 g of Bolobo 2-4 crude, having a total acid number of 7.2 mg KOH/g, and 6.15 g of methanol were put into the autoclave, which was then closed and heated to 350° C. with stirring. A sample taken after 30 minutes showed that the total acid number had dropped to 1.1 mg KOH/g corresponding to an 85% conversion of naphthenic acids. Infrared examination showed that the band at 1708 $cm^{-1}$ had become very small, compared to the band in the spectrum of untreated Bolobo 2-4. A very intense band at 1742 $cm^{-1}$ showed the formation of ester groups.

EXAMPLE 12

The reaction apparatus was the 300 ml autoclave described in Example 1. 100 g of Gryphon crude, having a total acid number of 4.2 mg KOH/g, and 2.4 g of methanol were put into the autoclave, which was then closed and heated to 350° C. A sample taken after 10 minutes had a total acid number of 0.6 mg KOH/g corresponding to an 85% conversion of naphthenic acids. Infrared examination showed that the band at 1708 $cm^{-1}$, attributed to carboxyl groups, had become much smaller than in the spectrum of untreated Gryphon. A new, intense band had appeared at 1742 $cm^{-1}$, attributed to ester groups.

EXAMPLE 13

The reaction apparatus was the 300 ml autoclave described in Example 1. 100 g of Gryphon crude, having a total acid number of 4.2 mg KOH/g, and 1.2 g of methanol were put into the autoclave, which was then closed and heated to 350° C. A sample taken after 30 minutes had a total acid number of 1.3 mg KOH/g corresponding to a 70% conversion of naphthenic acids.

EXAMPLE 14

The reaction apparatus was the 300 ml autoclave described in Example 1. 100 g of Bolobo 2-4 crude, having a total acid number of 7.2 mg KOH/g, and 2.06 g of methanol were put into the autoclave, which was then closed and heated to 350° C. A sample taken after 30 minutes had a total acid number of 0.4 mg KOH/g corresponding to a 94% conversion of naphthenic acids.

The following examples illustrate that the 650° $F.^{+}$ fraction of a crude may be esterified more rapidly than the crude from which it originated.

EXAMPLE 15

The reaction apparatus was a 300 ml autoclave. 100 g of Heidrun, having a total acid number of 2.7 mg KOH/g of oil, determined according to ASTM D-664, and 1.51 g of methanol were put into the autoclave, which was then closed. The autoclave was heated to 350° C. while stirring. Samples were taken 10, 20, 60 and 120 minutes after reaching 350° C. The following table gives the residual acidities.

| Time, minutes | Residual Acidity, mg KOH/g |
|---|---|
| 10 | 2.1 |
| 20 | 1.9 |
| 60 | 1.4 |
| 120 | .6 |

EXAMPLE 16

The reaction apparatus was the same autoclave described in Example 1. 100 g of Heidrun 650+, i.e. the portion of Heidrun boiling above 650° F., were put into the autoclave. Its total acid number was 3.6 mg KOH/g. 2.1 g of methanol were added, then the autoclave was closed and heated at 350° C. with stirring.

Samples were taken 30, 60 and 120 minutes after reaching 350° C. The following table gives the residual acidities.

| Time, minutes | Residual Acidity, mg KOH/g |
|---|---|
| 30 | .5 |
| 60 | .5 |
| 120 | .5 |

Comparison with Example 15 shows that Heidrun 650+ esterifies faster than crude Heidrun.

EXAMPLE 17

The reaction apparatus was the same autoclave described in Example 1. 100 g of Gryphon 650+, i.e., the portion of Gryphon remaining after the fractions boiling below 650° F. had been distilled, were put into the autoclave. The total acid number of Gryphon 650+ was 3.8 mg KOH/g. 2.17 g of menthanol were added, then the autoclave was closed and heated to 350° C. with stirring. Samples were taken 10, 20 and 30 minutes after the temperature of 350° C. was reached. The following table gives the results.

| Time, minutes | Residual Acidity, mg KOH/g |
|---|---|
| 10 | .4 |
| 20 | .4 |
| 30 | .4 |

Comparison with Example 12 shows the Gryphon 650+ esterifies at least as fast as crude Gryphon.

EXAMPLE 18

The reaction apparatus was the same autoclave used in Example 1. 100 g of San Joaquin Valley crude, having a total acid number of 3.8 mg KOH/g, determined according to ASTM D-664, were loaded into the autoclave. 2.17 g of menthanol were added, then the autoclave was closed and heated with agitation. After the temperature reached 350° C., samples were taken and titrated with KOH. The following table gives the results.

| Time, minutes | Residual Acidity, mg KOH/g |
|---|---|
| 10 | 2.3 |
| 20 | 2.1 |
| 30 | 1.8 |

EXAMPLE 19

The reaction apparatus was the same as in Example 1. 100 g of San Joaquin Valley 650+, i.e., the product remaining after the fractions boiling up to 650° F. had been distilled, were put into the autoclave. The total acid number of San Joaquin Valley 650+ was 2.9 mg KOH/g. 1.65 g of methanol were added, then the autoclave was closed and heated to 350° C. with stirring. Samples were taken 10, 20 and 30 minutes after the temperature of 350° C. was reached. The following table gives the results.

| Time, minutes | Residual Acidity, mg KOH/g |
|---|---|
| 10 | .9 |
| 20 | .7 |
| 30 | .8 |

Comparison with example 18 shows that San Joaquin Valley 650+ esterifies faster than San Valley crude.

What is claimed is:

1. A process for reducing the acidity of a petroleum oil containing organic acids comprising treating said petroleum oil containing organic acids with an amount of alcohol, said alcohol being added to said petroleum oil in an amount to obtain a molar ratio of said organic acid to said alcohol of about 1:0.5 to about 1:20, at a pressure of about 100 to about 300 kPa and at a temperature sufficient to form the corresponding ester of said alcohol, and wherein the petroleum oil is an acidic whole crude or topped crude and wherein said process is conducted in the absence of added catalyst and wherein said petroleum oil containing organic acids has an acid neutralization number of 0.5 to 10 mg KOH/acid.

2. The process of claim 1 wherein the petroleum oil containing organic acid is a petroleum oil containing naphthenic acid.

3. The process of claim 1 wherein the process is carried out at a temperature of about 250° C. or higher.

4. The process of claim 1 wherein said alcohol is selected from the group consisting of alkanols and alkane diols and mixtures thereof.

5. The process of claim 4 wherein said alkanol is selected from $C_1$ to $C_6$ alkanols.

6. The process of claim 5 wherein said alkanol is selected from the group consisting of ethanol, methanol, and mixtures thereof.

7. The process of claim 6 wherein said alkanol is methanol.

8. The process of claim 4 wherein said alkane diols are $C_2$ to $C_6$ alkane diols.

9. The process of claim 1 wherein said petroleum oil is separated into a 650° $F.^+$ boiling fraction and a 650° $F.^-$ boiling fraction and said 650° $F.^+$ boiling fraction is treated separately from said 650° $F.^-$ fraction.

* * * * *